US009824652B2

(12) United States Patent
Kim et al.

(10) Patent No.: US 9,824,652 B2
(45) Date of Patent: Nov. 21, 2017

(54) DISPLAY APPARATUS AND OPERATION METHOD THEREOF

(71) Applicant: SAMSUNG DISPLAY CO., LTD., Yongin, Gyeonggi-Do (KR)

(72) Inventors: Yunmi Kim, Changwon-si (KR); Kihyun Pyun, Gwangmyeong-si (KR); Sung-Jun Kim, Cheonan-si (KR); Kyung-Hwa Lim, Seoul (KR); Juhyun Kim, Asan-si (KR); Yongjae Lee, Seoul (KR); Jeongdoo Lee, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 250 days.

(21) Appl. No.: 14/462,064

(22) Filed: Aug. 18, 2014

(65) Prior Publication Data

US 2015/0206487 A1 Jul. 23, 2015

(30) Foreign Application Priority Data

Jan. 23, 2014 (KR) ..... 10-2014-0008487

(51) Int. Cl.
*G09G 3/36* (2006.01)

(52) U.S. Cl.
CPC ..... *G09G 3/3614* (2013.01); *G09G 3/3696* (2013.01); *G09G 2310/08* (2013.01); *G09G 2320/0209* (2013.01)

(58) Field of Classification Search
CPC G09G 5/00; G09G 3/003; G09G 3/36; G09G 3/3614; G09G 3/3696; G09G 2320/0209; G09G 2310/08; G09G 2300/0823; G09G 2310/0254; G09G 2310/068; G01R 13/00; G01R 13/0227; G01R 13/26; G01R 19/0038;

(Continued)

(56) References Cited

U.S. PATENT DOCUMENTS 7,327,358 B2 2/2008 Tajiri et al.
2007/0164963 A1* 7/2007 Kim ..... G09G 3/3655 345/98

(Continued)

FOREIGN PATENT DOCUMENTS

JP 2000-056292 A 2/2000
KR 1020050096685 A 10/2005

(Continued)

*Primary Examiner* — Son Le
(74) *Attorney, Agent, or Firm* — Cantor Colburn LLP

(57) ABSTRACT

A display apparatus includes: a display panel which displays an image; a data driver which supplies a data voltage to the display panel in response to a polarity control signal, where the polarity control signal controls a polarity of the data voltage; a timing controller which outputs a polarity signal corresponding to a polarity of the data voltage; and a polarity converter which receives a common voltage from a common electrode of the display panel and the polarity signal from the timing controller, where the polarity converter outputs the polarity control signal to the data driver in response to a difference in voltage level between the common voltage from the common electrode and the polarity signal from the timing controller.

9 Claims, 7 Drawing Sheets

(58) Field of Classification Search
CPC ..... G01R 19/16566; G01R 19/257; G01R 23/005; G01R 25/005; G06G 7/1935; Y10S 320/15
See application file for complete search history.

(56) References Cited

U.S. PATENT DOCUMENTS

| | | | | |
|---|---|---|---|---|
| 2009/0167659 | A1* | 7/2009 | Kim | G09G 3/3655 345/89 |
| 2010/0277399 | A1 | 11/2010 | Yu et al. | |
| 2012/0218249 | A1 | 8/2012 | Koo | |
| 2014/0092077 | A1* | 4/2014 | Kim | G09G 3/3611 345/212 |

FOREIGN PATENT DOCUMENTS

| | | | |
|---|---|---|---|
| KR | 1020070043358 | A | 4/2007 |
| KR | 1020070071424 | A | 7/2007 |

* cited by examiner

FIG. 6

| T1 | T2 | Bout |
|---|---|---|
| HIGH | HIGH | LOW |
| LOW | LOW | LOW |
| HIGH | LOW | HIGH |
| LOW | HIGH | HIGH |

DISPLAY APPARATUS AND OPERATION METHOD THEREOF

This application claims priority to Korean Patent Application No. 10-2014-0008487, filed on Jan. 23, 2014, and all the benefits accruing therefrom under 35 U.S.C. §119, the content of which in its entirety is herein incorporated by reference.

BACKGROUND

1. Field

Exemplary embodiments of the invention disclosed herein relate to a display apparatus, and more particularly, to a display apparatus that controls a polarity inverting signal to enhance display quality of a display panel, and an operation method thereof.

2. Description of the Related Art

A liquid crystal display ("LCD") includes a liquid crystal material having anisotropic permittivity and provided between two substrates. When an electric field is applied to the liquid crystal material and the intensity of the electric field is adjusted, the amount of a light passing through a substrate is adjusted. As a result, a desired image is displayed on the LCD.

Each pixel of the LCD includes red, green and blue sub pixels that adjust light transmittance by changing the arrangement of a liquid crystal based on a data voltage. Each sub pixel charges the differential voltage between a data voltage supplied to a pixel electrode and a common voltage supplied to a common electrode through a thin film transistor ("TFT") to operate the liquid crystal. The TFT provides the pixel electrode with the data voltage supplied to a data line in response to a gate voltage supplied to a gate line.

Due to coupling caused in the process of operating a display apparatus, the common voltage supplied to the common electrode may have ripples. Accordingly, the differential voltage between the picture electrode and the common electrode may vary, such that horizontal crosstalk may occur on a display panel, and display quality may decrease.

SUMMARY

Exemplary embodiments of the invention provide a display apparatus having enhanced operation reliability and an operation method thereof.

Exemplary embodiments of the invention provide a display apparatus including: a display panel which displays an image; a data driver which supplies a data voltage to the display panel in response to a polarity control signal, where the polarity control signal controls a polarity of the data voltage; a timing controller which outputs a polarity signal corresponding to a polarity of the data voltage; and a polarity converter which receives a common voltage from a common electrode of the display panel and the polarity signal from the timing controller, where the polarity converter outputs the polarity control signal to the data driver in response to a difference in voltage level between the common voltage from the common electrode and the polarity signal from the timing controller.

In other exemplary embodiments of the invention, a method of operating a display includes: receiving a polarity signal of a data voltage, where the data voltage is applied to a display panel of the display apparatus, and the polarity signal includes a positive polarity signal and a negative polarity signal; receiving a common voltage from a common electrode of the display panel; comparing a voltage level of the common voltage with each of voltage levels of the positive polarity signal and the negative polarity signal in the polarity signal; selecting one of the positive polarity signal and the negative polarity signal based on a comparison result of the voltage levels of the common voltage and each of the voltage levels of the positive polarity signal and the negative polarity signal; and outputting one of the polarity signal and the selected one of the positive polarity signal and the negative polarity signal in response to a selection signal, where when a difference between the voltage levels of the common voltage and the positive polarity signal is different from a difference between the voltage levels of the common voltage and the negative polarity signal, the selected one of the positive polarity signal and the negative polarity signal is output based on the selection signal, and when the difference between the voltage levels of the common voltage and the positive polarity signal is substantially the same as the difference between the voltage levels of the common voltage and the negative polarity signal, the polarity signal is output based on the selection signal.

BRIEF DESCRIPTION OF THE DRAWINGS

The above and other features of the invention will become more apparent by describing in further detail exemplary embodiments thereof with reference to the accompanying drawings, in which:

FIG. 6 is a table showing bit values output from the second pulse comparator shown in FIG. 2.

DETAILED DESCRIPTION

Figure 1:
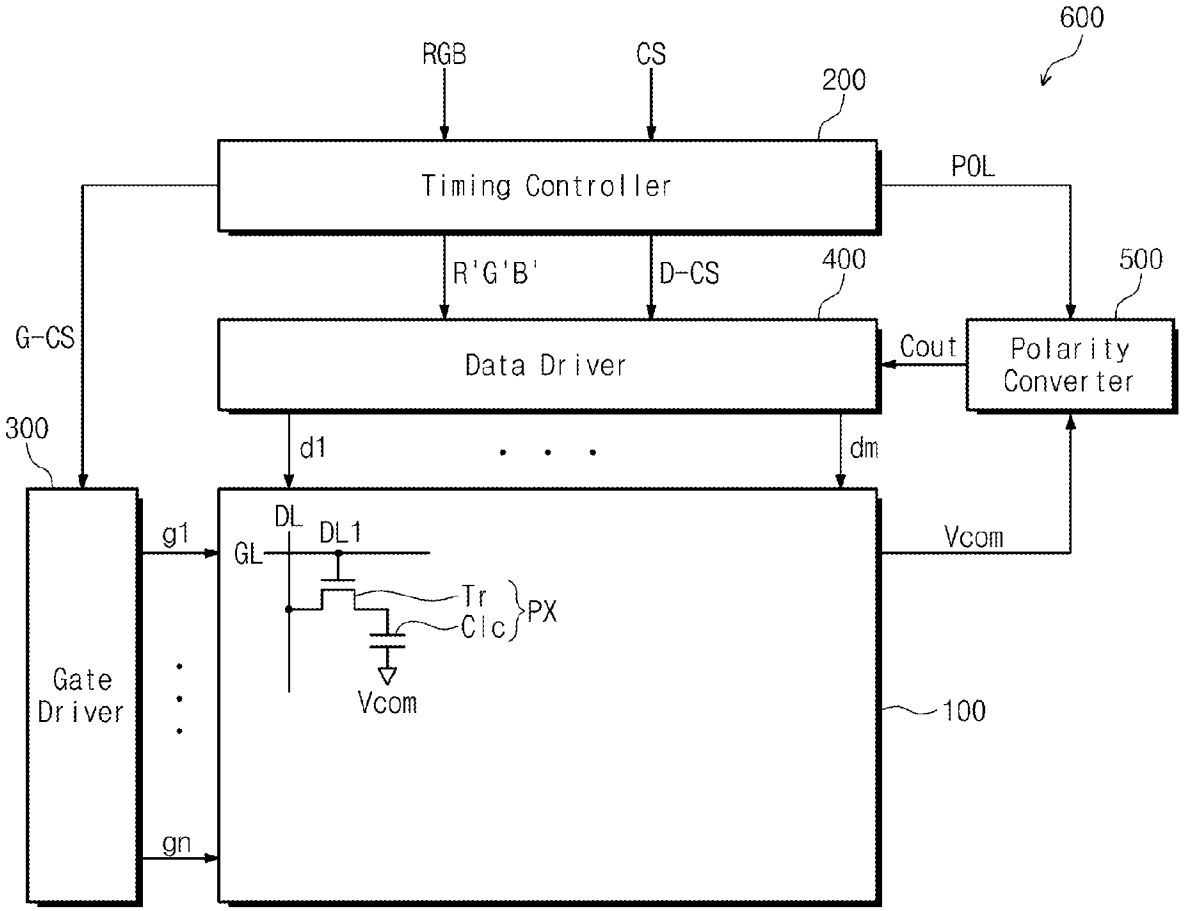
FIG. 1 is a block diagram of an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings FIG. 1 is a block diagram of an exemplary embodiment of a display apparatus according to the invention.

Referring to FIG. 1, an exemplary embodiment of a display apparatus 600 includes a display panel 100, a timing controller 200, a gate driver 300, a data driver 400 and a polarity converter 500.

The display panel 100 includes a plurality of pixels PX. For convenience of illustration, FIG. 1 shows a pixel PX, a gate line GL and a data line DL that are connected to the pixel PX. However, in such an embodiment, a plurality of gate lines and a plurality of data lines are actually arranged on the display panel 100 and connected to corresponding pixels PX. The pixels PX may be arranged substantially in a matrix form.

The gate lines extend substantially in a row direction and may be arranged to cross the data lines extending substantially in a column direction. The pixels PX are connected to corresponding gate and data lines GL and DL, respectively.

The pixel PX connected to the gate line GL and the data line DL includes a thin film transistor Tr and a liquid crystal capacitor Clc connected to the thin film transistor Tr. The thin film transistor Tr includes a gate electrode connected to the gate line GL, a source electrode connected to the data line DL, and a drain electrode connected to the liquid crystal capacitor Clc. Other pixels also have the same configuration as the pixel PX shown in FIG. 1.

In such an embodiment, the liquid crystal capacitor Clc is formed by a pixel electrode (not shown) connected electrically to the drain electrode of the thin film transistor Tr, a common electrode (not shown) facing the pixel electrode, and a liquid crystal layer (not shown) arranged between the pixel electrode and the common electrode. The differential voltage between a data voltage supplied to the pixel electrode and a common voltage Vcom supplied to the common electrode may be charged in the liquid crystal capacitor Clc.

The timing controller 200 receives a plurality of image signals RGB and a plurality of control signals CS from an outside of the display apparatus 600. The timing controller 200 converts the data format of the image signals RGB to correspond to, e.g., to be suitable for, an interface specification with the data driver 400, based on the plurality of image signals RGB. Converted image signals R'G'B' having a converted data format are provided to the data driver.

In an exemplary embodiment, the timing controller 200 generates a gate control signal G-CS, a data control signal D-CS and a polarity inverting signal POL based on the control signals CS.

The gate driver 300 sequentially outputs a plurality of gate signals g1 to gn in response to the gate control signal G-CS provided from the timing controller 200. The pixels PX may be scanned sequentially on a row-by-row basis by the gate signals g1 to gn.

The data driver 400 converts the converted image signals R'G'B' into a plurality of data voltages d1 to dm in response to the data control signal D-CS provided from the timing controller 400 and a polarity control signal Cout provided from the polarity converter 500. The data driver 400 provides the data voltages d1 to dm to the pixels PX of the display panel 100.

The pixels PX receive the data voltages d1 to dm in response to the gate signals g1 to gn. The pixels PX display a grayscale corresponding to the data voltages d1 to dm. Thus, images may be displayed by the pixels PX.

The polarity converter 500 receives the polarity inverting signal POL from the timing controller 200 and receives the common voltage Vcom from the display panel 100. The polarity converter 500 may determine the polarities of the data voltages d1 to dm in response to the received common voltage Vcom and the received polarity inverting signal POL. In an exemplary embodiment, the polarity converter 500 determines the polarities of the data voltages d1 to dm based on whether the common voltage Vcom has ripples. Then, the polarity converter 500 generates the polarity control signal Cout that controls the polarities of the data voltages d1 to dm and transmits the polarity control signal Cout to the data driver 400.

In an exemplary embodiment, the polarity inverting signal POL may be a signal, the polarity of which varies every frame. In such an embodiment, the display apparatus 600 may change or maintain the polarities of the data voltages d1 to dm, in each frame.

Figure 2:
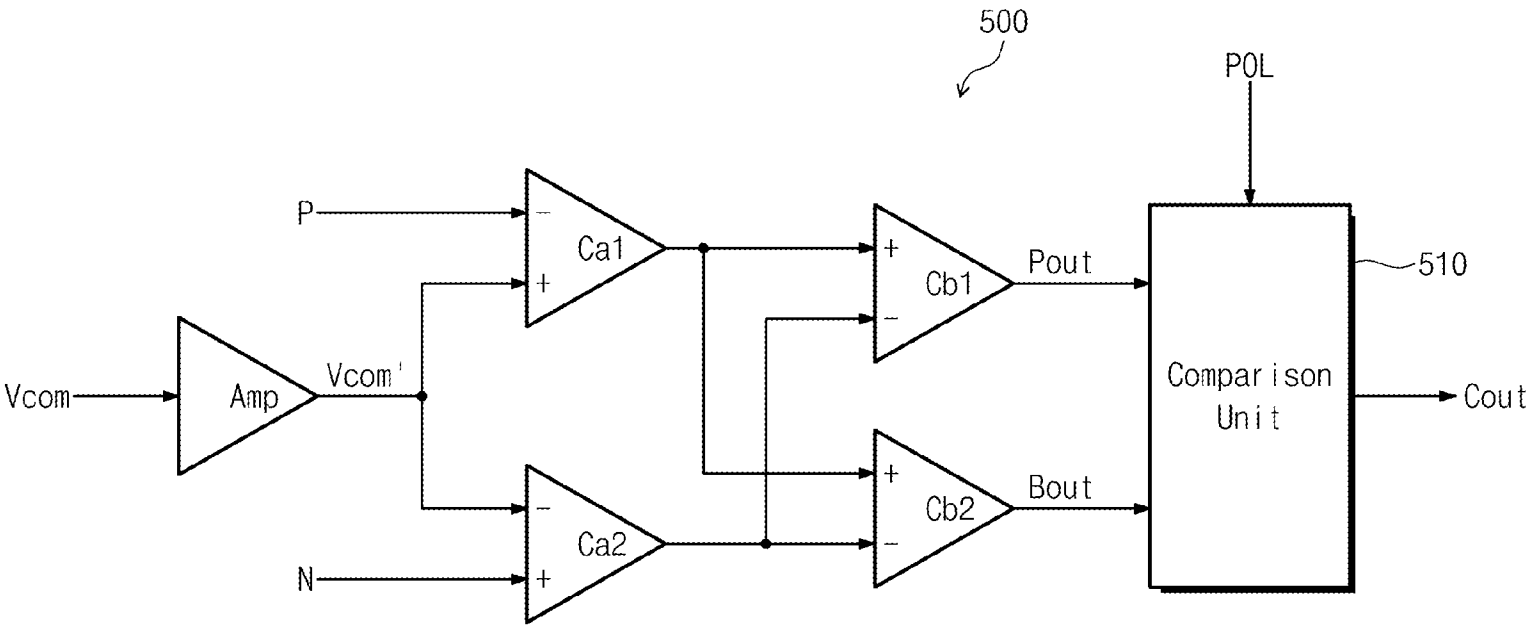
FIG. 2 is a diagram showing an exemplary embodiment of a polarity converter shown in FIG. 1.

FIG. 2 is a diagram showing an exemplary embodiment of a polarity converter shown in FIG. 1.

Referring to FIG. 2, an exemplary embodiment of the polarity converter 500 includes a non-inverting amplifier Amp, a first comparator Ca1, a second comparator Ca2, a first pulse comparator Cb1, a second pulse comparator Cb2 and a comparison unit 510.

The non-inverting amplifier Amp receives the common voltage Vcom from the display panel 100. In an exemplary embodiment, the non-inverting amplifier Amp may amplify a voltage level of a section of received common voltage Vcom including a ripple. Such a ripple component included in the common voltage Vcom may be generated due to coupling caused by the operation of the display panel 100. The non-inverting amplifier Amp transmits an amplified common voltage Vcom' to the first comparator Ca1 and the second comparator Ca2.

The first comparator Ca1 receives a positive polarity signal P from the timing controller 200 (see FIG. 1) and receives an amplified common voltage Vcom' from the non-inverting amplifier Amp. In an exemplary embodiment, as shown in FIG. 2, the first comparator Ca1 receives the positive polarity signal P through a first input terminal (−) and receives the amplified common voltage Vcom' through a second input terminal (+).

In such an embodiment, when a voltage level applied to the first input terminal (−) is higher than that applied to the second input terminal (+), the first comparator Ca1 outputs a low-level pulse signal. In such an embodiment, when the voltage level applied to the first input terminal (−) is lower than that applied to the second input terminal (+), the first comparator Ca1 outputs a high-level pulse signal.

As described above, in such an embodiment, the first comparator Ca1 compares the level of the received positive polarity signal P with that of the amplified common voltage Vcom' and generates a first pulse comparison signal based on a comparison result thereof. The first comparator Ca1 transmits the first pulse comparison signal to the first pulse comparator Cb1 and the second pulse comparator Cb2.

The second comparator Ca2 receives a negative polarity signal N from the timing controller 200 and receives the amplified common voltage Vcom' from the non-inverting amplifier Amp. In an exemplary embodiment, as shown in FIG. 2, the second comparator Ca2 receives the negative polarity signal N through a first input terminal (+) and receives the amplified common voltage Vcom' through a second input terminal (−).

In such an embodiment, when a voltage level applied to the first input terminal (+) is higher than that applied to the second input terminal (−), the second comparator Ca2 outputs a low-level pulse signal. In such an embodiment, when the voltage level applied to the first input terminal (+) is lower than that applied to the second input terminal (−), the second comparator Ca2 outputs a high-level pulse signal.

As described above, in such an embodiment, the second comparator Ca2 compares the level of the received negative polarity signal N with that of the amplified common voltage Vcom' and generates a second pulse comparison signal based on a comparison result thereof. The second comparator Ca2 transmits the second pulse comparison signal to the first pulse comparator Cb1 and the second pulse comparator Cb2.

The first pulse comparator Cb1 receives the first pulse comparison signal from the first comparator Ca1 and receives the second pulse comparison signal from the second comparator Ca2. In an exemplary embodiment, as shown in FIG. 2, the first pulse comparator Cb1 receives the first pulse comparison signal through a first input terminal (+) and receives the second pulse comparison signal through a second input terminal (−).

The first pulse comparator Cb1 compares the high-level section based pulse widths of the first and the second pulse comparison signals. That is, the first pulse comparator Cb1 determines whether the high-level section of the first pulse comparison signal is longer or shorter than that of the second pulse comparison signal.

In such an embodiment, when the high-level section of the first pulse comparison signal is longer than that of the second pulse comparison signal, the first pulse comparator Cb1 transmits a polarity selection signal Pout based on the positive polarity signal P to the comparison unit 510. In such an embodiment, when the high-level section of the first pulse comparison signal is shorter than that of the second pulse comparison signal, the first pulse comparator Cb1 transmits the polarity selection signal Pout based on the negative polarity signal N to the comparison unit 510.

The second pulse comparator Cb2 receives the first pulse comparison signal from the first comparator Ca1 and receives the second pulse comparison signal from the second comparator Ca2. In an exemplary embodiment, as shown in FIG. 2, the second pulse comparator Cb2 receives the first pulse comparison signal through a first input terminal (+) and receives the second pulse comparison signal through a second input terminal (−).

In an exemplary embodiment, the second pulse comparator Cb2 may be a counter comparator. In such an embodiment, the second pulse comparator Cb2 may generate N bits corresponding to the polarity of each frame in response to the received first and second pulse comparison signals. The second pulse comparator Cb2 transmits, to the comparison unit 510, a selection signal Bout corresponding to N bits based on a comparison result thereof. The operation of the comparison unit 510 will be described later in greater detail with reference to FIGS. 6 and 7.

Figure 3:
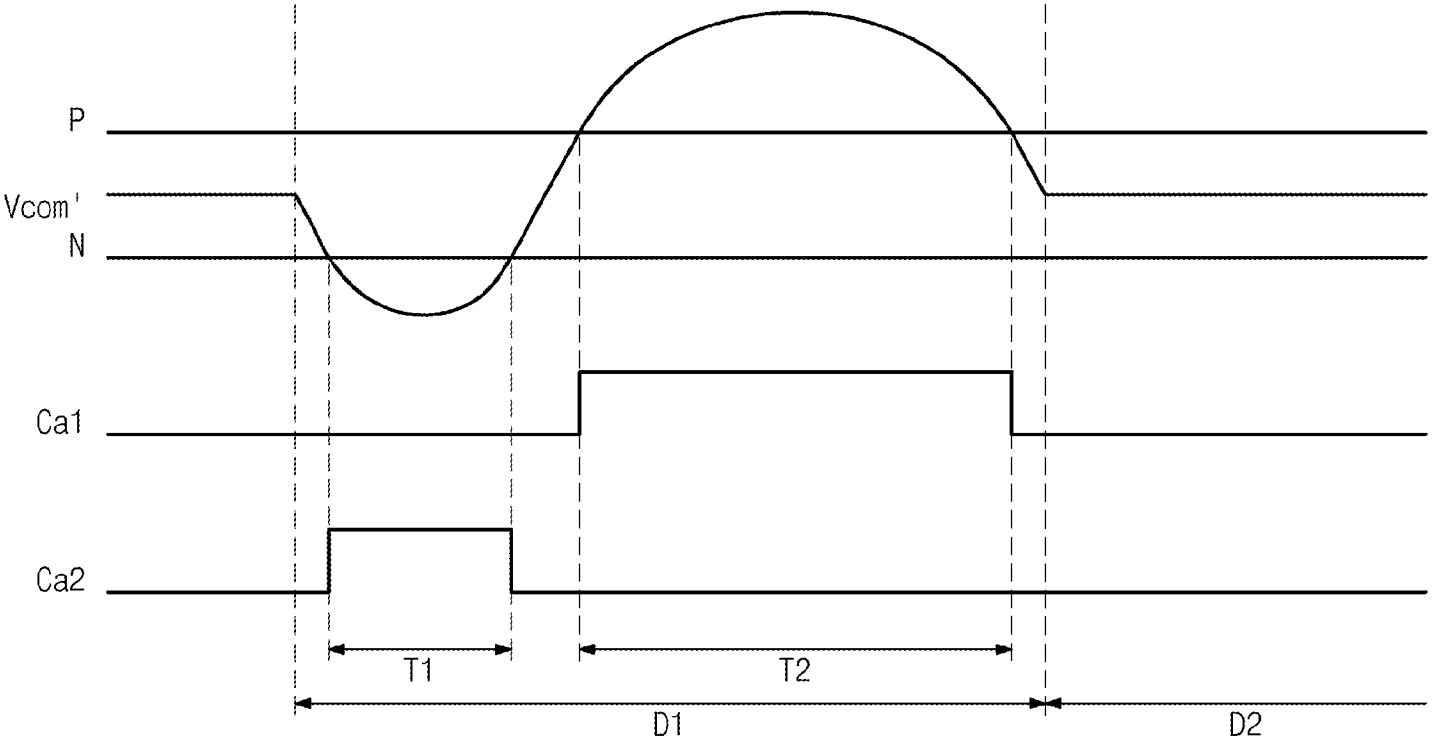
FIG. 3 is a timing diagram showing pulse outputs according to the operations of a first and a second comparator shown in FIG. 2.

FIG. 3 is a timing diagram showing pulse outputs according to the operations of a first and a second comparator shown in FIG. 2.

Referring to FIGS. 2 and 3, the first and the second comparators Ca1 and Ca2 receive the positive and negative polarity signals P and N, respectively. In one exemplary embodiment, for example, the positive polarity signal P may be set to have a voltage level higher than a voltage level of the negative polarity signal N. In such an embodiment, the common voltage Vcom' amplified from the non-inverting amplifier Amp may have a first section D1 having ripples and a second section D2 having no ripples.

In the first section D1 having ripples, the first comparator Ca1 compares the voltage level of the positive polarity signal P with the voltage level of the amplified common voltage Vcom'. In an exemplary embodiment, the first comparator Ca1 outputs the first comparison signal in a high level during a period in which the voltage level of the amplified common voltage Vcom' is higher than the voltage level of the positive polarity signal P. In an exemplary embodiment, as shown in FIG. 3, the voltage level of the amplified common voltage Vcom' may be higher than the voltage level of the positive polarity signal P for a second time period T2 in the first section D1. In such an embodiment, the first comparator Ca1 outputs the first pulse comparison signal having a high-level pulse signal during the second time period T2 in the first section D1.

The second comparator Ca2 compares the voltage level of the negative polarity signal N with the voltage level of the amplified common voltage Vcom'. In an exemplary embodiment, the second comparator Ca2 outputs the first comparison signal in a high level during a period in which the voltage level of the amplified common voltage Vcom' may be lower than the voltage level of the negative polarity signal N. In an exemplary embodiment, as shown in FIG. 3, the voltage level of the amplified common voltage Vcom' may be lower than the voltage level of the negative polarity signal N for a first time period T1 in the first section D1. In such an embodiment, the second comparator Ca2 outputs the second pulse comparison signal having a high-level pulse signal during the first time period T1 in the first section D1.

In the second section D2 having no ripples, the first and the second comparators Ca1 and Ca2 output first and second pulse comparison signals having no high-level pulse signals.

Figure 4:
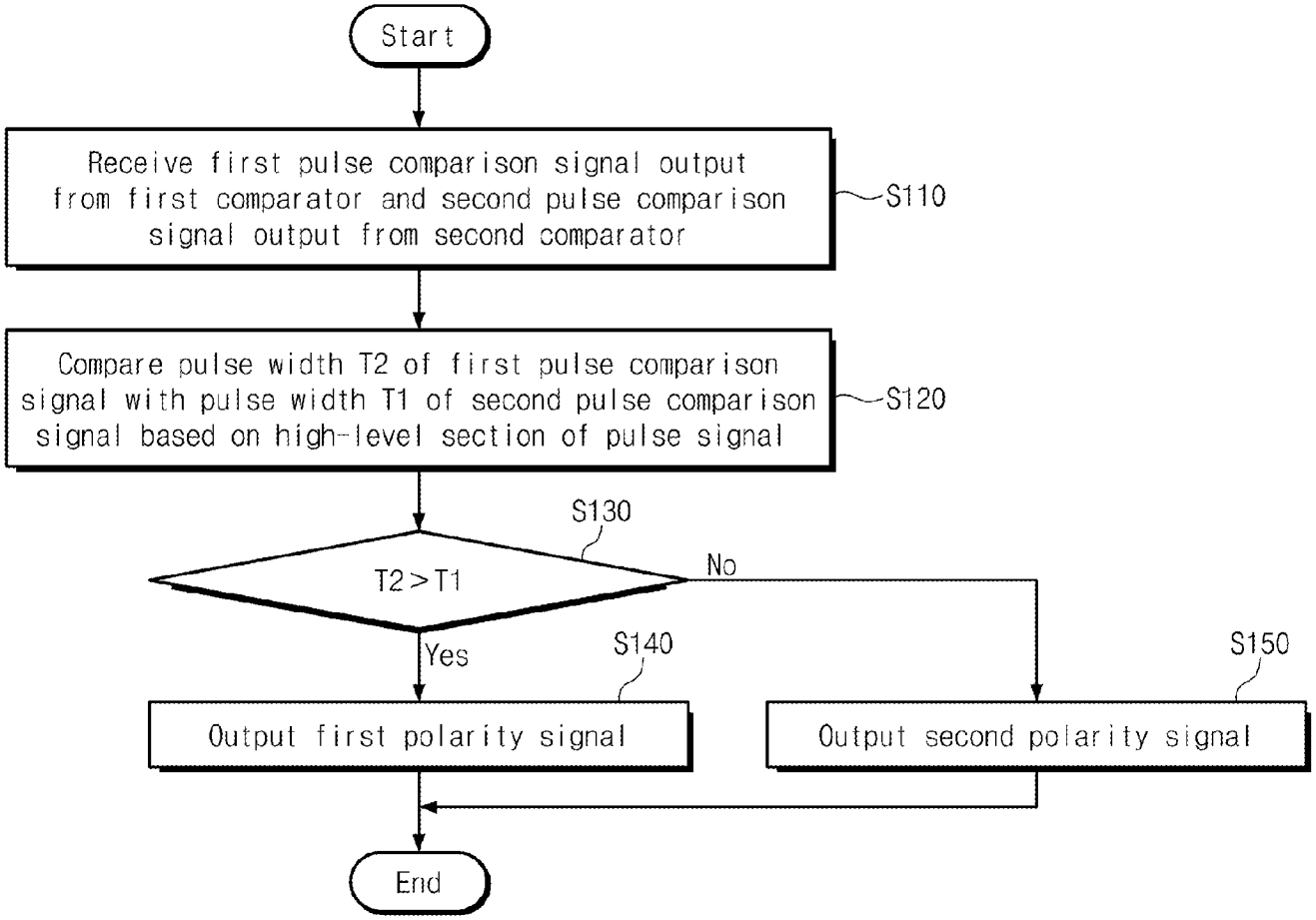
FIG. 4 is a flow chart showing the operation of a first pulse comparator shown in FIG. 2.

FIG. 4 is a flow chart of the operation of the first pulse comparator shown in FIG. 2.

Referring to FIGS. 2 and 4, in an exemplary embodiment, the first pulse comparator Cb1 receives the first and the second pulse comparison signals from the first and the second comparators Ca1 and Ca2 (S110).

In such an embodiment, the first pulse comparator Cb1 compares the high-level section based pulse width T2 of the first pulse comparison signal with the high level section based pulse width T1 of the second pulse comparison signal (S120).

In such an embodiment, when the high pulse width (e.g., the second time period T2 in FIG. 3) of the first pulse comparison signal is longer than the high level pulse width (e.g., the first time period T1 in FIG. 3) of the second pulse comparison signal (S130), the first pulse comparator Cb1 outputs a first polarity signal based on the positive polarity signal P (S140).

In such an embodiment, when the high-level pulse width T2 of the first pulse comparison signal is shorter than the high level pulse width T1 of the second pulse comparison signal (S130), the first pulse comparator Cb1 outputs a second polarity signal based on the negative polarity signal N (S150).

Figure 5:
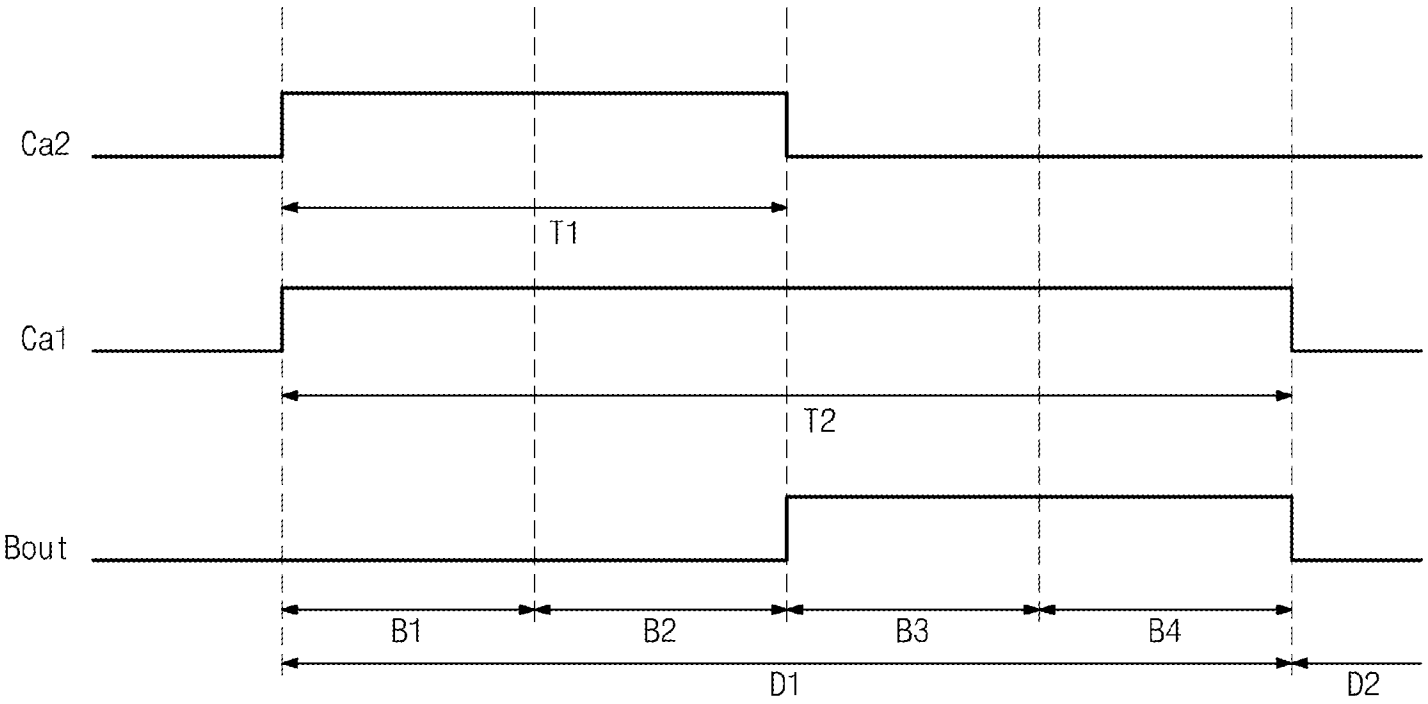
FIG. 5 is a timing diagram showing outputs according to the operation of a second pulse comparator shown in FIG. 2.

FIG. 5 is a timing diagram showing the operation of the second pulse comparator shown in FIG. 2. FIG. 6 is a table showing bit values output from the second pulse comparator shown in FIG. 2.

Referring to FIGS. 2 and 5, in the first section D1 of the common voltage having ripples, the second pulse comparator Cb2 compares the high-level pulse signals T1 and T2 of the first and the second comparators Ca1 and Ca2.

In an exemplary embodiment, in the first section D1 of the common voltage having ripples, the second pulse comparator Cb2 may generate first to fourth bits B1 to B4 that determine the polarity of the selection signal Bout in each frame. That is, the second pulse comparator Cb2 may output a section signal based on the first to fourth bits B1 to B4. In an exemplary embodiment of the invention, four bits are generated from the second pulse comparator Cb2, as shown in FIGS. 5 and 6, but the invention is not limited thereto. In an alternative exemplary embodiment, the number of bits generated from the second pulse comparator Cb2 may be variously adjusted.

According to the table shown in FIG. 6, the second pulse comparator Cb2 may output a selection signal based on each bit.

In one exemplary embodiment, for example, as shown in FIG. 6, when the pulse signal T2 of the first comparator Ca1 is in a high level and the pulse signal T1 of the second comparator Ca2 is in a high level, the second pulse comparator Cb2 outputs a low signal as the selection signal Bout, that is, the selection signal Bout having a bit value of "0".

In such an embodiment, when the pulse signal T2 of the first comparator Ca1 is in a low level and the pulse signal T1 of the second comparator Ca2 is in a low level, the second pulse comparator Cb2 outputs a low signal as the selection signal Bout, that is, the selection signal Bout having a bit value of "0".

In such an embodiment, when the pulse signal T2 of the first comparator Ca1 is in a high level and the pulse signal T1 of the second comparator Ca2 is in a low level, the second pulse comparator Cb2 outputs a high signal as the selection signal Bout, that is, the selection signal Bout having a bit value of "1".

In such an embodiment, when the pulse signal T2 of the first comparator Ca1 is in a low level and the pulse signal T1 of the second comparator Ca2 is in a high level, the second pulse comparator Cb2 outputs a high signal as the selection signal Bout, that is, the selection signal Bout having a bit value of "1".

Referring back to FIG. 5, the second pulse comparator Cb2 outputs a "LOW" signal having a bit value of "0" as the selection signal Bout of the first bit B1, where the pulse signal T2 of the first comparator Ca1 is in a high level and the pulse signal T1 of the second comparator Ca2 is in a high level.

The second pulse comparator Cb2 outputs a "LOW" signal having a bit value of "0" as the selection signal Bout of a second bit B2, where the pulse signal T2 of the first comparator Ca1 is in a low level and the pulse signal T1 of the second comparator Ca2 is in a low level.

The second pulse comparator Cb2 outputs a "HIGH" signal having a bit value of "1" as the selection signal Bout of a third bit B3, where the pulse signal T2 of the first comparator Ca1 is in a high level and the pulse signal T1 of the second comparator Ca2 is in a low level.

The second pulse comparator Cb2 outputs a "HIGH" signal having a bit value of "1" as the selection signal Bout of a fourth bit B4, where the pulse signal T2 of the first comparator Ca1 is in a high level and the pulse signal T1 of the second comparator Ca2 is in a low level.

As described above, in an exemplary embodiment, the second pulse comparator Cb2 compares the pulse comparison signals of the first and the second comparators Ca1 and Ca2 in the section of the common voltage having ripples. The second pulse comparator Cb2 outputs the selection signal Bout corresponding to each bit based on a comparison result.

Figure 7:
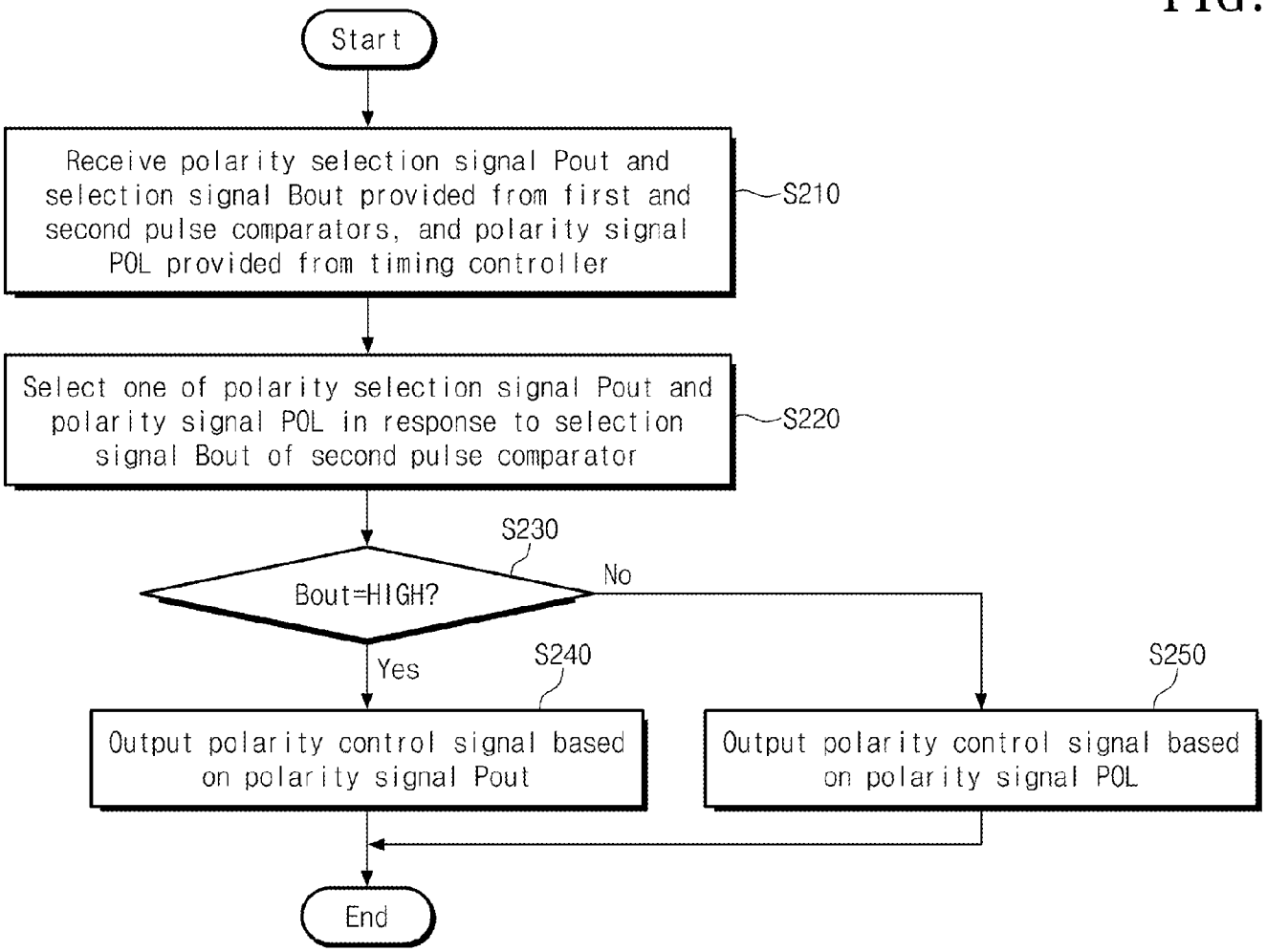
FIG. 7 is a flow chart of the operation of a comparison unit shown in FIG. 2.

FIG. 7 is a flow chart of the operation of the comparison unit shown in FIG. 2.

Referring to FIGS. 2 and 7, in an exemplary embodiment, the comparison unit 510 receives the polarity selection signal Pout provided from the first pulse comparator Cb1, the selection signal Bout provided from the second pulse comparator Cb2, and the polarity signal POL provided from the timing controller 200 (S210).

In such an embodiment, the comparison unit 510 selects one of the polarity selection signal Pout and the polarity signal POL in response to the selection signal Bout corresponding to each bit (S220). In an exemplary embodiment, the comparison unit 510 may determine the polarities of data voltages applied to the display panel 100 (see FIG. 1) based on the selection signal corresponding to each bit. In one exemplary embodiment, for example, a time period of the selection signal Bout corresponding to each bit may be determined on a frame-by-frame basis, e.g., may be substantially equal to one frame.

In such an embodiment, the comparison unit 510 determines whether the selection signal Bout corresponding to each bit received from the second pulse comparator Cb2 is a "HIGH" signal (S230). When a received selection signal Bout is the "HIGH" signal, the comparison unit 510 outputs the polarity control signal Cout having the polarity selection signal Pout output from the first pulse comparator Cb1 (S240).

In one exemplary embodiment, for example, when the common voltage has no ripples, the comparison unit 510 sequentially determines the polarities of the data voltages as "(+), (−), (+), (−)" based on the polarity signal POL. However, when the common voltage has ripples, the comparison unit 510 may sequentially determine the polarities of the data voltages as "(+), (−), (+), (+)" based on the polarity selection signal Pout.

In such an embodiment, when the received selection signal Bout is a "LOW" signal (S230), the comparison unit 510 outputs the polarity control signal Cout having the polarity signal POL output from the timing controller 200 (S250).

In such an embodiment, when the common voltage received from the display panel 100 has no ripples, the comparison unit 510 outputs the polarity control signal Cout having the polarity signal POL output from the timing controller 200. However, when the common voltage received from the display panel 100 has ripples, the comparison unit 510 may change the polarity signal of the data voltage to maintain the differential voltage between the data voltage and a pixel electrode. That is, the comparison unit 510 may adjust the polarity of the data voltage based on whether the common voltage has ripples.

As described above, in exemplary embodiments of the invention, the display apparatus adjusts the polarity of the data voltage and may thus compensate the defect caused by the voltage difference between the pixel electrode and a common electrode due to the ripples of the common voltage. In such embodiments, the positive polarity signal may allow an image displayed on the display panel to be brighter and the negative polarity signal may allow the image displayed on the display panel to be darker. According to exemplary embodiments as described herein, the display apparatus adjusts the polarity of the data voltage and may thus effectively prevent a display defect such as horizontal crosstalk caused by the common voltage. Some exemplary embodiments of the invention are disclosed in the drawings and the specification as above. Although specific terms are used herein, they are only intended to describe exemplary embodiments of the invention and are not intended to limit meanings or the scope of the invention described in the following claims. Therefore, a person skilled in the art may understand that various variations and equivalent embodiments may be implemented. Thus, the true protective scope of the invention will be defined by the technical spirit of the following claims.

What is claimed is:

1. A display apparatus comprising:

a display panel which displays an image;

a data driver which supplies a data voltage to the display panel in response to a polarity control signal, wherein the polarity control signal controls a polarity of the data voltage;

a timing controller which outputs a polarity signal comprising a positive polarity signal and a negative polarity signal corresponding to the polarity of the data voltage; and a polarity converter which receives a common voltage fed back from a common electrode of the display panel and the polarity signal from the timing controller, the polarity converter comparing a first voltage difference between a voltage level of the common voltage and a voltage level of the positive polarity signal with a second voltage difference between the voltage level of the common voltage and a voltage level of the negative polarity signal wherein when the first voltage difference is different from the second voltage difference, the polarity converter outputs one of the positive polarity signal and the negative polarity signal, and when the first voltage difference is substantially the same as the second voltage difference, the polarity converter outputs the polarity signal received from the timing controller, wherein the polarity converter comprises:

a non-inverting amplifier which amplifies a level of the common voltage;

a first comparator which compares the voltage level of the positive polarity signal with the amplified voltage level of the common voltage, wherein the first comparator outputs a first pulse comparison signal based on a comparison result thereof;

a second comparator which compares the voltage level of the negative polarity signal with the amplified voltage level of the common voltage, wherein the second comparator outputs a second pulse comparison signal based on a comparison result thereof;

a first pulse comparator which compares pulse widths of the first and the second pulse comparison signals from the first and second comparators, respectively, wherein the first pulse comparator selects the one of the positive polarity and negative polarity signals based on a comparison result thereof, and outputs the selected one of the positive polarity and negative polarity signals as a polarity selection signal;

a second pulse comparator which outputs a selection signal in response to the first and the second pulse comparison signals from the first and second comparators, respectively; and a comparison unit which selects one of the polarity selection signal and the polarity signal based on the selection signal from the second pulse comparator, wherein the comparison unit outputs the polarity control signal based on the selected one of the polarity selection signal and the polarity signal.

2. The display apparatus of claim 1, wherein the first comparator outputs a low-level signal when the voltage level of the positive polarity signal is higher than the amplified voltage level of the common voltage, and the first comparator outputs a high-level signal when the voltage level of the positive polarity signal is lower than the amplified voltage level of the common voltage.

3. The display apparatus of claim 1, wherein the second comparator outputs a low-level signal when the voltage level of the negative polarity signal is lower than the amplified voltage level of the common voltage, and the second comparator outputs a high-level signal when the voltage level of the negative polarity signal is higher than the amplified voltage level of the common voltage.

4. The display apparatus of claim 1, wherein the second pulse comparator generates N bits corresponding to each frame in response to the first and the second pulse comparison signals, wherein N is a positive integer.

5. The display device of claim 4, wherein the second pulse comparator comprises a counter.

6. The display apparatus of claim 4, wherein the second pulse comparator outputs the selection signal having a high-level bit value when levels of the first and the second pulse comparison signals are substantially the same as each other, and the second pulse comparator outputs the selection signal having a low-level bit value when the levels of the first and the second pulse comparison signals are different from each other.

7. The display apparatus of claim 6, wherein the comparison unit outputs the polarity selection signal as the polarity control signal when the selection signal has the high-level bit value, and the comparison unit outputs the polarity signal as the polarity control signal when the selection signal has the low level bit value.

8. The display apparatus of claim 1, wherein the positive polarity signal has a higher voltage level than the negative polarity signal.

9. The display apparatus of claim 1, wherein the polarity signal of the data voltage varies every frame.

* * * * *